US009535361B2

(12) United States Patent
Yokoi

(10) Patent No.: US 9,535,361 B2
(45) Date of Patent: Jan. 3, 2017

(54) IMAGE FORMING APPARATUS AND METHOD OF CONTROLLING BEAM SCANNING DEVICE

(71) Applicant: Brother Kogyo Kabushiki Kaisha, Nagoya-shi, Aichi-ken (JP)

(72) Inventor: Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/078,063

(22) Filed: Mar. 23, 2016

(65) Prior Publication Data

US 2016/0282749 A1 Sep. 29, 2016

(30) Foreign Application Priority Data

Mar. 23, 2015 (JP) ..... 2015-059457

(51) Int. Cl.
*G03G 15/00* (2006.01)
*B41J 2/44* (2006.01)
*G03G 15/043* (2006.01)

(52) U.S. Cl.
CPC ..... *G03G 15/043* (2013.01)

(58) Field of Classification Search
USPC ..... 399/1–4, 177, 179, 220, 221; 347/235, 347/243
See application file for complete search history.

(56) References Cited

U.S. PATENT DOCUMENTS 7,379,084 B2 * 5/2008 Kobuse ..... B41J 2/473 347/235
7,852,365 B2 * 12/2010 Naito ..... G02B 26/123 347/243
9,056,490 B2 * 6/2015 Kusuda ..... B41J 2/44
9,199,480 B2 * 12/2015 Yoshida ..... G03G 15/0435
2004/0037584 A1 2/2004 Takahashi et al.

FOREIGN PATENT DOCUMENTS

JP 2003200609 A 7/2003
JP 2005148628 A 6/2005
JP 2011224999 A 11/2011

* cited by examiner

*Primary Examiner* — Hoan Tran
(74) *Attorney, Agent, or Firm* — Banner & Witcoff, Ltd.

(57) ABSTRACT

An image forming apparatus, including: a polygon mirror; a first optical sensor; a second optical sensor; and a controller configured to (a) determine a second-beam exposure standby time which is a time period from a timing when the first beam deflected by a first surface of the polygon mirror has been detected by the first sensor to a timing when scanning exposure of the second beam deflected by a second surface of the polygon mirror is started, based on a measured time which is a time period from the timing of detection by the first sensor to a timing of detection of the second beam by the second sensor and (b) start the scanning exposure of the second beam deflected by the second surface when the second-beam exposure standby time elapses after the first beam deflected by the first surface has been detected by the first optical sensor.

10 Claims, 9 Drawing Sheets

IMAGE FORMING APPARATUS AND METHOD OF CONTROLLING BEAM SCANNING DEVICE

CROSS REFERENCE TO RELATED APPLICATION

The present application claims priority from Japanese Patent Application No. 2015-059457, which was filed on Mar. 23, 2015, the disclosure of which is herein incorporated by reference in its entirety.

BACKGROUND

Technical Field

The following disclosure relates to an image forming apparatus having a beam scanning device configured to scan and expose a photoconductor using a polygon mirror and a method of controlling the beam scanning device.

Description of Related Art

There is known an image forming apparatus equipped with a beam scanning device including: first and second light beam sources; a polygon mirror configured to reflect first and second beams respectively emitted from the first and second light beam sources; a first scanning optical system disposed on one side of the polygon mirror for focusing the first beam on a first photoconductor; and a second scanning optical system disposed on another side of the polygon mirror for focusing the second beam on a second photoconductor. In the known apparatus, an optical sensor is provided upstream of the first scanning optical system in a scanning direction of the first beam for detecting the first beam, whereas no optical sensors are provided for the second scanning optical system.

In the known apparatus, scanning exposure of the first beam is started when a predetermined first-beam exposure standby time elapses after detection of the first beam by the one optical sensor, and scanning exposure of the second beam is started when a predetermined second-beam exposure standby time elapses after the detection of the first beam. (Here, the first-beam exposure standby time is defined as a time period from a timing of detection of the first beam to a timing of start of the scanning exposure of the first beam, and the second-beam exposure standby time is defined as a time period from the timing of detection of the first beam to a timing of start of the scanning exposure of the second beam.) Further, the known apparatus determines the second-beam exposure standby time based on time intervals at which the one optical sensor detects the first beam, in consideration of an error in surface division accuracy of the polygon mirror, namely, in consideration of an error in the angle among different mirror surfaces of the polygon mirror. Thus, a position of an image formed by the first beam and a position of an image formed by the second beam are aligned in a width direction of a sheet.

SUMMARY

The above known apparatus, however, does not detect an actual second beam, so that there is a possibility that the second-beam exposure standby time cannot be determined accurately.

An aspect of the disclosure relates to a technique of accurately determining the second-beam exposure standby time based on results of detection of the second beam.

In one aspect of the disclosure, an image forming apparatus includes: a first light beam source and a second light beam source; a polygon mirror configured to deflect a first beam emitted from the first light beam source and a second beam emitted from the second light beam source; a first scanning optical system disposed on one side of the polygon mirror and configured to focus the first beam deflected by the polygon mirror on a first photoconductor; a first optical sensor disposed at an upstream portion of the first scanning optical system in a scanning direction of the first beam and configured to detect the first beam detected by the polygon mirror; a second scanning optical system disposed on another side of the polygon mirror and configured to focus the second beam deflected by the polygon mirror on a second photoconductor; a second optical sensor disposed at a downstream portion of the second scanning optical system in a scanning direction of the second beam and configured to detect the second beam deflected by the polygon mirror; and a controller, wherein the controller is configured to determine a second-beam exposure standby time which is a time period from a timing when the first beam deflected by a first surface of the polygon mirror has been detected by the first optical sensor to a timing when scanning exposure of the second beam deflected by a second surface of the polygon mirror different from the first surface is started, based on a measured time which is a time period from the timing when the first beam deflected by the first surface has been detected by the first optical sensor to a timing when the second beam deflected by the second surface is detected by the second optical sensor, and wherein the controller is configured to start the scanning exposure of the second beam deflected by the second surface when the second-beam exposure standby time elapses after the first beam deflected by the first surface has been detected by the first optical sensor.

In another aspect of the disclosure, an image forming apparatus includes: a first light beam source configured to emit a first beam; a second light beam source configured to emit a second beam; a polygon mirror; a first scanning optical system disposed on one side of the polygon mirror and configured to focus the first beam; a first optical sensor disposed at an upstream portion of the first scanning optical system in a scanning direction of the first beam; a second scanning optical system disposed on another side of the polygon mirror and configured to focus the second beam; a second optical sensor disposed at a downstream portion of the second scanning optical system in a scanning direction of the second beam; and a controller, wherein the controller is configured to: control the polygon mirror to rotate; control the first light beam source to emit a first beam; control the second light beam source to emit a second beam; obtain a measured time which is a time period from a timing when the first beam deflected by a first surface of the polygon mirror has been detected by the first optical sensor and a timing when the second beam deflected by a second surface of the polygon mirror different from the first surface is detected by the second optical sensor; determine, based on the measured time, a second-beam exposure standby time which is a time period from the timing when the first beam deflected by the first surface is detected by the first optical sensor to a timing when scanning exposure of the second beam deflected by the second surface is started; and start the scanning exposure of the second beam deflected by the second surface when the second-beam exposure standby time elapses after the first beam deflected by the first surface has been detected by the first optical sensor.

In still another aspect of the disclosure, a method of controlling a beam scanning device including: a first light beam source and a second light beam source; a polygon mirror configured to deflect a first beam emitted from the first light beam source and a second beam emitted from the second light beam source; a first scanning optical system disposed on one side of the polygon mirror and configured to focus the first beam deflected by the polygon mirror on a first photoconductor; a first optical sensor disposed at an upstream portion of the first scanning optical system in a scanning direction of the first beam and configured to detect the first beam detected by the polygon mirror; a second scanning optical system disposed on another side of the polygon mirror and configured to focus the second beam deflected by the polygon mirror on a second photoconductor; and a second optical sensor disposed at a downstream portion of the second scanning optical system in a scanning direction of the second beam and configured to detect the second beam deflected by the polygon mirror, the method including: determining a second-beam exposure standby time which is a time period from a timing when the first beam deflected by a first surface of the polygon mirror has been detected by the first optical sensor to a timing when scanning exposure of the second beam deflected by a second surface of the polygon mirror different from the first surface is started, based on a measured time which is a time period from the timing when the first beam deflected by the first surface has been detected by the first optical sensor to a timing when the second beam deflected by the second surface is detected by the second optical sensor; and starting the scanning exposure of the second beam deflected by the second surface when the second-beam exposure standby time elapses after the first beam deflected by the first surface has been detected by the first optical sensor.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF EMBODIMENT

Figure 1:
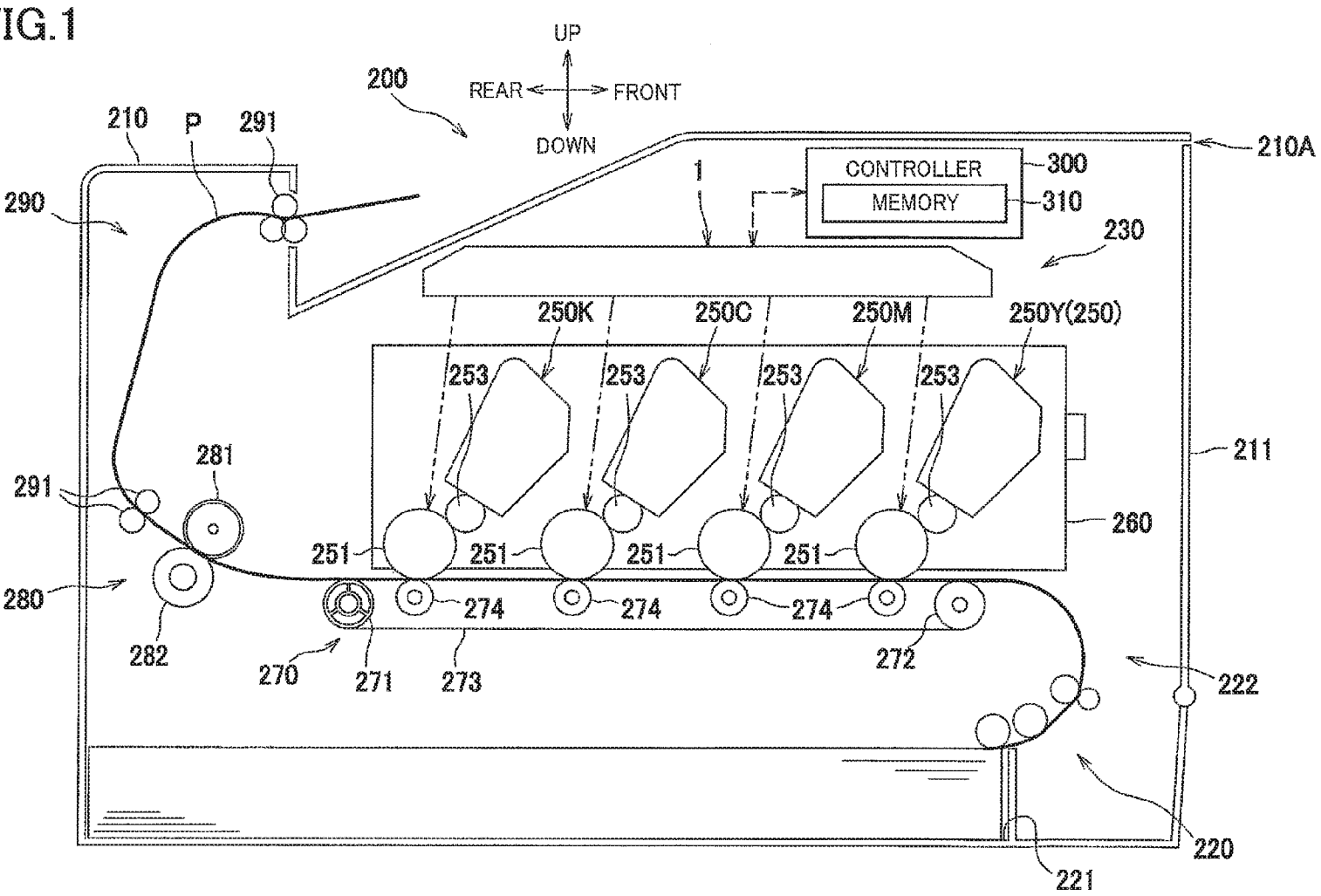
FIG. 1 is a view of a color printer according to one embodiment.

Referring to the drawings, there will be explained in detail one embodiment. There will be first explained an overall structure of a color printer 200, as one example of an image forming apparatus, and next explained characteristic features of the disclosure.

In the following explanation, the right side and the left side in FIG. 1 are respectively defined as a front side and a rear side of the color printer 200. One of opposite sides of the sheet of FIG. 1 corresponding to the front surface of the sheet is defined as a left side of the color printer 200 while the other side corresponding to the back surface of the sheet is defined as a right side of the color printer 200. Further, the up-down direction in FIG. 1 is defined as an up-down direction of the color printer 200.

As shown in FIG. 1, the color printer 200 includes, in its body housing 210, a sheet supply portion 220 configured to supply a sheet P, an image forming portion 230 configured to form an image on the supplied sheet P, a sheet-discharge portion 290 configured to discharge the sheet P on which the image has been formed, and a controller 300.

The sheet supply portion 220 includes a sheet supply tray 221 in which the sheets P are accommodated and a sheet conveyor 222 configured to convey each of the sheets P from the sheet supply tray 221 to the image forming portion 230.

The image forming portion 230 includes a scanner unit 1 as one example of a beam scanning device, four process cartridges 250, a holder 260, a transfer unit 270, and a fixing device 280.

The scanner unit 1 configured to expose surfaces of a plurality of photoconductive drums 251 is provided at an upper portion of the body housing 210. The scanner unit 1 and the controller 300 for controlling the scanner unit 1 will be later explained in detail.

The process cartridges 250 are disposed above the sheet supply portion 220 so as to be arranged in a front-rear direction. Each process cartridge 250 includes a photoconductive drum 251 as one example of a photoconductor, a known charger (not shown), a developing roller 253, and a toner chamber. The four process cartridges 250 store toner in respective four colors, i.e., black, cyan, magnets, and yellow. When referring to the process cartridge 250 and the photoconductive drum 251 for toner in one particular color in the specification and the drawings, a corresponding one of suffixes K, C, M, and Y respectively indicating black, cyan, magenta, and yellow is attached.

The holder 260 integrally holds the four process cartridges 250. The holder 260 is movable in the front-rear direction through an opening 210A formed by opening a front cover 211 provided on the front of the body housing 210.

The transfer unit 270 is provided between the sheet supply portion 220 and the four process cartridges 250 and includes a drive roller 271, a driven roller 272, a conveying belt 273, and transfer roller 274.

The drive roller 271 and the driven roller 272 are spaced apart from each other in the front-rear direction so as to be in parallel with each other. The conveying belt 273, which is as an endless belt, is tensioned between the drive roller 271 and the driven roller 272. Four transfer rollers 274 are disposed provided inside the conveying belt 273 so as to be opposed to the respective four photoconductive drums 251. Each transfer roller 274 nips the conveying belt 273 with a corresponding one of the photoconductive drums 251.

The fixing device 280 is disposed rearward of the four process cartridges 250 and the transfer unit 270. The fixing device 280 includes a heating roller 281 and a pressing roller 282. The pressing roller 282 is disposed so as to be opposed to the heating roller 281 for pressing the heating roller 281.

In the image forming portion 230, each of the surfaces of the photoconductive drums 251 is uniformly charged by the charger and exposed by the scanner unit 1, so that an electrostatic latent image based on image data is formed on the photoconductive drum 251. Thereafter, the toner in the toner chamber is supplied by the developing roller 253 to the electrostatic latent image on the photoconductive drum 251, so that a toner image is formed on the photoconductive drum 251.

Subsequently, the sheet P supplied onto the conveying belt 273 passes between the photoconductive drums 251 and the transfer rollers 274, so that the toner images formed on the respective photoconductive drums 251 are transferred onto the sheet P. The toner images transferred onto the sheet P are thermally fixed by the fixing device 280.

The sheet-discharge portion 290 includes a plurality of conveying rollers 291 for conveying the sheet P. The sheet P onto which the toner images have been transferred and thermally fixed is conveyed by the conveying rollers 291 and is discharged outside the body housing 210.

The structure of the scanner unit 1 will be explained in detail. In the following explanation, each of directions in which respective laser beams LY, LM, LC, LK are deflected is referred to as a main scanning direction. Further, a sub scanning direction is defined as a direction orthogonal to the main scanning direction on a surface (image surface) of the photoconductive drum 251.

Figure 2:
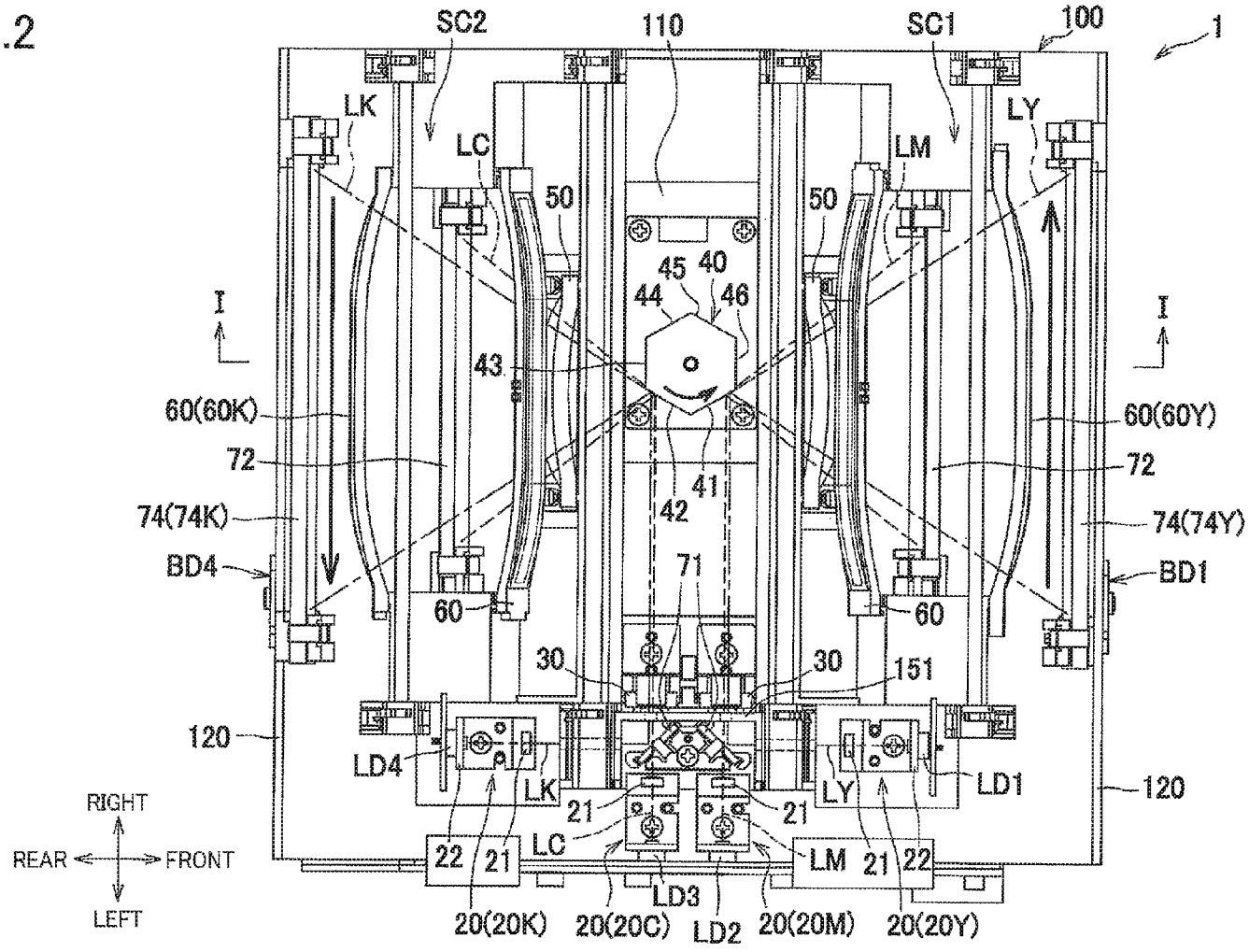
FIG. 2 is a plan view of a scanner unit.
Figure 3:
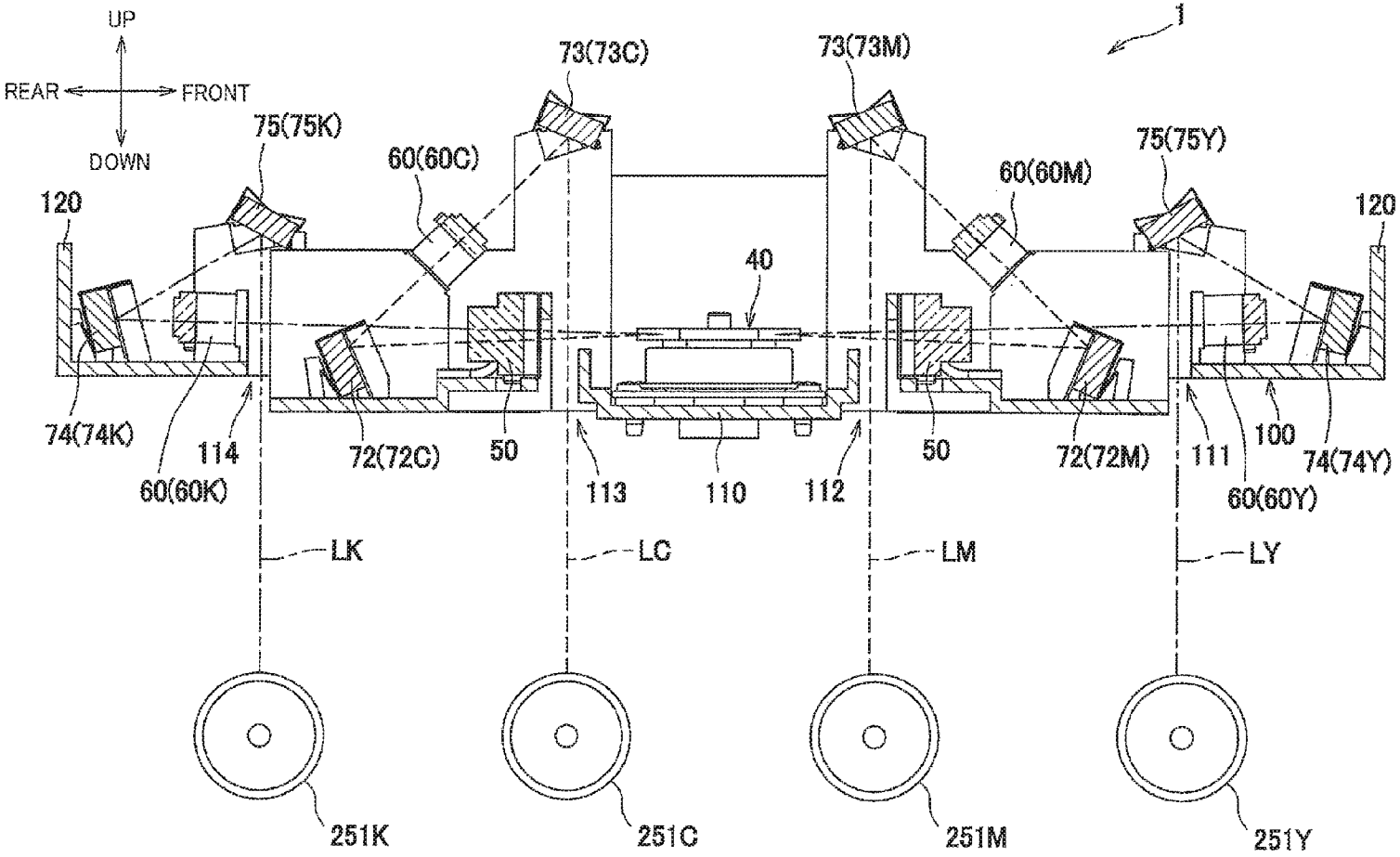
FIG. 3 is a cross-sectional view taken along line I-I in FIG. 2.

As shown in FIGS. 2 and 3, the scanner unit 1 includes a casing 100, four light beam source devices 20 (20Y, 20M, 20C, 20K), two reflecting mirrors 71, two first cylindrical lenses 30, a polygon mirror 40, a first scanning optical system SC1 disposed on the front side of the polygon mirror 40, and a second scanning optical system SC2 disposed on the rear side of the polygon mirror 40.

The light beam source devices 20Y, 20M, 20C, 20K respectively emit laser beams LY, LM, LC, LK. The four light beam source devices 20Y, 20M, 20C, 20K are provided so as to correspond to the four photoconductive drums 251Y, 251M, 251C, 251K to be scanned and exposed by the scanner unit 1. The light beam source device 20M and the light beam source device 20C are disposed alongside in the front-rear direction and configured to respectively emit the laser beams LM, LC in a right-left direction. The light beam source device 20Y and the light beam source device 20K are disposed so as to face each other in the front-rear direction. The light beam source devices 20Y, 20K are disposed relative to the light beam source devices 20M, 20C such that the laser beams LY, LK respectively emitted from the light beam source devices 20Y, 20K are substantially orthogonal to the laser beams LM, LC respectively emitted from the light beam source devices 20M, 20C.

Each of the light beam source devices 20Y-20K includes a corresponding one of semiconductor lasers LD1-LD4, a coupling lens 21, and a frame 22. Each of the semiconductor lasers LD1, LD2 disposed on the front side of a rotation axis of the polygon mirror 40 corresponds to a first light beam source while each of the semiconductor lasers LD3, LD4 disposed on the rear side of the rotation axis corresponds to a second light beam source. For the sake of convenience, the semiconductor lasers LD1, LD2, each as the first light beam source, will be referred to as first semiconductor lasers LD1, LD2, and the semiconductor lasers LD3, LD4, each as the second light beam source, will be referred to as second semiconductor lasers LD3, LD4. Further, the laser beams LY, LM based on respective laser lights emitted from the respective first semiconductor lasers LD1, LD2 will be referred to as first beams LY, LM. The laser beams LC, LK based on respective laser lights emitted from the respective second semiconductor lasers LD3, LD4 will be referred to as the second beams LC, LK.

The coupling lens 21 of each of the light beam source devices 20Y-20K converts a laser light which is divergently emitted from a corresponding one of the semiconductor lasers LD1-LD4 into a corresponding one of the laser beams LY-LK. In the present embodiment, the laser beams obtained by conversion via the coupling lenses 21 may be any of parallel beams, convergent beams, and divergent beams.

Each of the reflecting mirrors 71 reflects, toward the polygon mirror 40, a corresponding one of the laser beam LY emitted from the light beam source device 20Y and the laser beam LK emitted from the light beam source device 20K. The reflecting mirrors 71 are disposed between the light beam source devices 20M, 20C and the polygon mirror 40. The laser light LM emitted from the light beam source device 20M and the laser light LC emitted from the light beam source device 20C pass over the reflecting mirrors 71 and reach the polygon mirror 40 so as to be incident thereon.

Each of the first cylindrical lenses 30 refracts the laser beams LM, LY or the laser beams LC, LK and converges the laser beams in the sub scanning direction, so as to correct a face tangle error of the polygon mirror 40. Consequently, the converged laser beams are focused on mirror surfaces 41-46 of the polygon mirror 40, so as to have a certain length in the main scanning direction. The first cylindrical lenses 30 are disposed between the reflecting mirrors 71 and the polygon mirror 40.

A plurality of openings (indicated by the broken line in FIG. 2) are formed in a wall 151 of the casing 100 provided between the reflecting mirrors 71 and the first cylindrical lenses 30. The openings of the wall 151 define widths, in the main scanning direction and the sub scanning direction, of the corresponding laser beams LY-LK that pass therethrough.

The polygon mirror 40 has six mirror surfaces 41-46 equally spaced apart from the rotation axis of the polygon mirror 40. The mirror surfaces 41-46 rotate about the rotation axis at a constant speed and reflect the laser beams LY-LK that have passed through the first cylindrical lenses 30, so as to deflect the laser beams LY-LK in the main scanning direction. Specifically, the polygon mirror 40 deflects the first beams LY, LM respectively emitted from the light beam source devices 20Y, 20M toward the first scanning optical system SC1 and deflects the second beams LC, LK emitted from the light beam source devices 20C, 20K toward the second scanning optical system SC2. The polygon mirror 40 is disposed at a substantially central portion of the casing 100 so as to be opposed to the light beam source devices 20M, 20C in the right-left direction. In the following explanation, a certain surface of the polygon mirror 40 will be referred to as a first mirror surface 41, and other mirror surfaces arranged following this first mirror surface 41 on an upstream side in the rotational direction of the polygon mirror 40 will be respectively referred to as a second mirror surface 42, a third mirror surface 43, a fourth mirror surface 44, a fifth mirror surface 45, and a sixth mirror surface 46.

The first scanning optical system SC1 is an optical system for focusing the respective first beams LY, LM deflected by the polygon mirror 40 on the photoconductive drums 251Y, 251M each as one example of a first photoconductor. The first scanning optical system SC1 includes one fθ lens 50, two second cylindrical lenses 60 (60Y, 60M), and a plurality of reflecting mirrors 72-75. The second scanning optical system SC2 is an optical system for focusing the respective second beams LC, LK deflected by the polygon mirror 40 on the photoconductive drums 251C, 251K each as one example of a second photoconductor. The second scanning optical system SC2 includes one fθ lens 50, two second cylindrical lenses 60 (60C, 60K), and a plurality of reflecting mirrors 72-75. Functions of the constituent components are substantially similar between the two scanning optical systems SC1, SC2 and will be collectively explained hereafter.

The fθ lens 50 converts the laser beams LY-LK scanned by the polygon mirror 40 at a constant angular speed so as to converge on the surfaces of the respective photoconductive drums 251 and so as to scan the surfaces of the respective photoconductive drums 251 in the main scanning direction at a constant speed. Two fθ lenses are provided respectively on the front side and the rear side of the polygon mirror 40.

The second cylindrical lens 60 refracts a corresponding one of the laser beams LY-LK and converges the laser beam in the sub scanning direction, so as to correct a face tangle error of the polygon mirror 40. Consequently, the converged laser beam is focused on the surface of the corresponding photoconductive drum 251. Four second cylindrical lenses 60 (60Y-60K) are provided so as to correspond to the respective four light beam source devices 20Y-20K.

The second cylindrical lenses 60M, 60C through which the respective laser beams LM, LC pass are disposed over the respective fθ lenses 50. The second cylindrical lenses 60Y, 60K through which the respective laser beams LY, LK pass are disposed between the respective fθ lenses 50 and respective side walls 120 of the casing 100, so as to be opposed to the corresponding side walls 120.

The reflecting mirrors 72-75 reflect the laser beams LY-LK and are formed by vapor deposition of a material having a high reflectance, such as aluminum, on a surface of a glass plate.

The reflecting mirrors 72 (72M, 72C) are disposed between the respective fθ lenses 50 and the respective second cylindrical lenses 60Y, 60K, so as to reflect the laser beams LM, LC having passed through the fθ lens 50 toward the second cylindrical lenses 60M, 60C. The reflecting mirrors 73 (73M, 73C) are disposed over the respective fθ lenses 50, so as to reflect the laser beams LM, LC having passed through the second cylindrical lenses 60M, 60C toward the surfaces of the photoconductive drums 251M, 251C.

The reflecting mirrors 74 (74Y, 74K) are disposed along the respective side walls 120 of the casing 100 between the second cylindrical lenses 60Y, 60K and the side walls 120. The reflecting mirrors 74 (74Y, 74K) reflect the laser beams LY, LK having passed through the second cylindrical lenses 60Y, 60K toward the reflecting mirrors 75. The reflecting mirrors 75 (75Y, 75K) are disposed over the respective second cylindrical lenses 60Y, 60K and reflect the laser beams LY, LK reflected by the reflecting mirrors 74 toward the surfaces of the photoconductive drums 251Y, 251K.

As shown in FIG. 2, in the configuration described above, the laser beams LM, LC respectively emitted from the light beam source devices 20M, 20C pass through the respective first cylindrical lenses 30 and are deflected by the polygon mirror 40 in the main scanning direction. Further, the laser beams LY, LK respectively emitted from the light beam source devices 20Y, 20K are reflected by the respective reflecting mirrors 71 so as to be directed toward the polygon mirrors 40, pass through the respective first cylindrical lenses 30, and are deflected by the polygon mirror 40 in the main scanning direction.

As shown in FIG. 3, the laser beams LM, LC deflected by the polygon mirror 40 pass through the respective fθ lenses 50 and are reflected by the respective reflecting mirrors 72. Then, after having passed through the respective second cylindrical lenses 60, the laser beams LM, LC are reflected by the respective reflecting mirrors 73 and scan and expose the surfaces of the photoconductive drums 251. Further, the laser beams LY, LK deflected by the polygon mirror 40 pass through the respective fθ lenses 50 and the respective second cylindrical lenses 60. Then, after having been reflected by the respective reflecting mirrors 74, the laser beams LY, LK are reflected by the respective reflecting mirrors 75 and scan and expose the surfaces of the photoconductive drums 251.

In other words, the first beam LY emitted from the light beam source device 20Y for yellow and the first beam LM emitted from the light beam source device 20M for magenta are reflected toward the first scanning optical system SC1 by one mirror surface of the polygon mirror 40 sequentially moved to a font-side obliquely left position, i.e., a position at which the first beams LY, LM impinge on the polygon mirror 40. The second beam LC emitted from the light beam source device 20C for cyan and the second beam LK emitted from the light beam source device 20K for black are reflected toward the second scanning optical system SC2 by one mirror surface of the polygon mirror 40 sequentially moved to a rear-side obliquely left position, i.e., a position at which the second beams LC, LK impinge on the polygon mirror 40.

A first sensor BD1, as one example of a first optical sensor, is disposed at an upstream portion of the first scanning optical system SC1 in a scanning direction of the first beam LY. The first sensor BD1 is configured to output a signal for determining a timing of start of scanning exposure which will be explained. A second sensor BD4 for correction, as one example of a second optical sensor, is disposed at a downstream portion of the second scanning optical system SC2 in a scanning direction of the second beam LK. The second sensor BD4 is configured to output a signal for correcting the timing of start of the scanning exposure.

Figure 4:
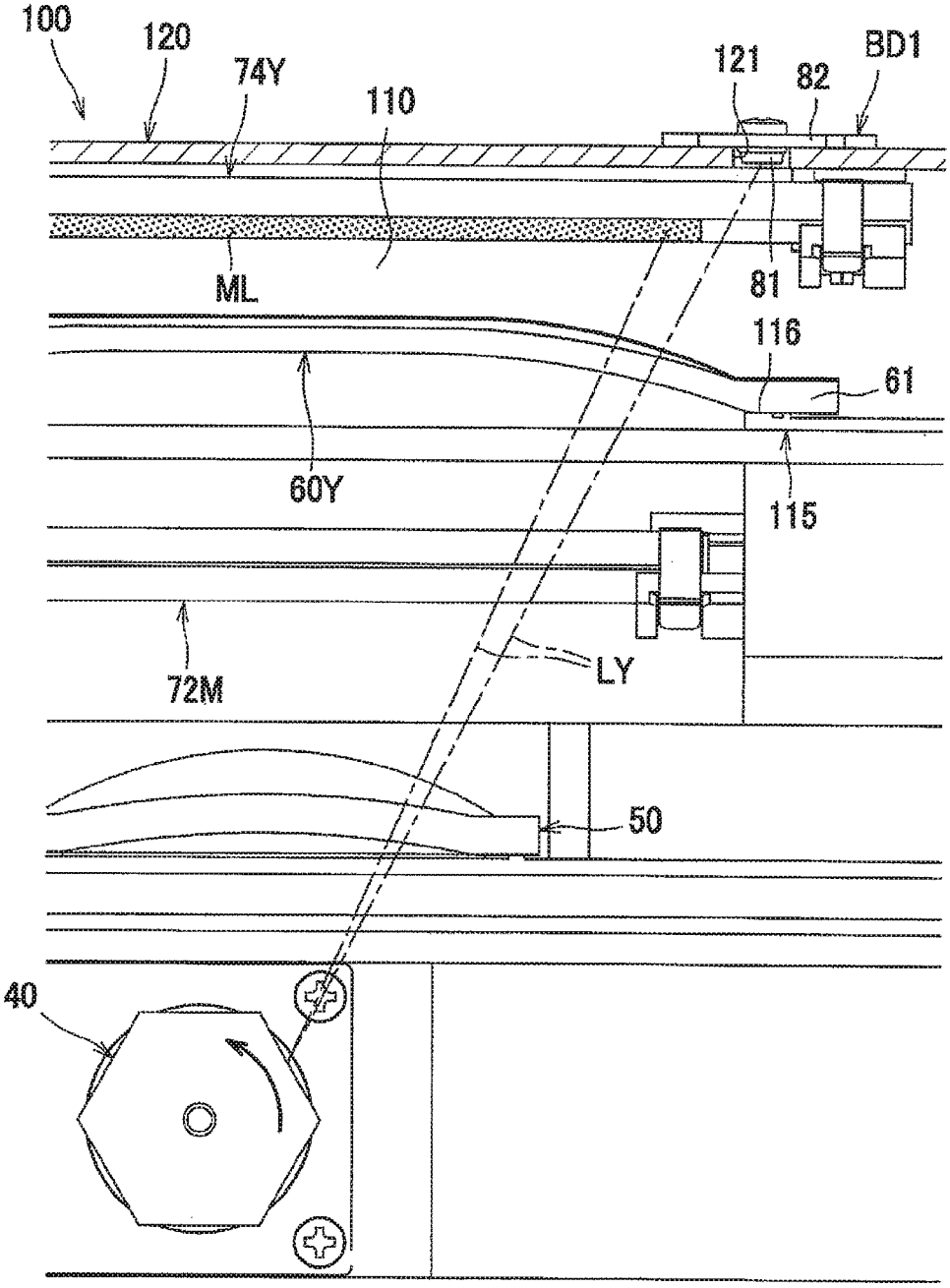
FIG. 4 is an enlarged plan view of the scanner unit.

As shown in FIG. 4, only one first sensor BD1 is provided in the scanner unit 1. The first sensor BD1 includes a light receiving element 81 for detecting the first beam LY and a circuit board 82 on which the light receiving element 81 is mounted. The first sensor BD1 is attached to the outer surface of the side wall 120 of the casing 100, so as to close an opening 121 formed in the side wall 120. Thus, the light receiving element 81 is disposed with a detecting surface thereof facing an inside of the casing 100.

The first sensor BD1 outputs the signal to the controller 300 when the light receiving element 81 detects the first beam LY. In response to reception of the signal from the first sensor BD1, the controller 300 determines a timing of emission of an exposure laser beam from each of the respective light beam source devices 20. Here, the exposure laser beam is a laser beam to expose the surface of the photoconductive drum 251 based on image data. Further, the scanning exposure (which may also be referred to as writing) means scanning, by the exposure laser beam, the surface of the photoconductive drum 251 over its width corresponding to a width of an image forming region of the sheet P and forming an image on the surface of the photoconductive drum 251.

As shown in FIG. 4, one longitudinal end portion of the reflecting mirror 74Y permits the laser beam LY to pass therethrough. Specifically, the reflecting mirror 74Y, which is formed by vapor deposition of a material having a high reflectance on a surface of a glass plate, does not have a mirror layer ML (indicated by dots in FIG. 4) at a portion thereof corresponding to the first sensor BD1. Consequently, the laser light LY that passes through the one longitudinal end portion of the reflecting mirror 74Y can be detected by the light receiving element 81. In other words, the first sensor BD1 is disposed upstream of the mirror layer ML in the scanning direction of the first beam LY.

As shown in FIG. 2, the second sensor BD4 is identical in construction with the first sensor BD1. The scanner unit 1 has only one second sensor BD4. The second sensor BD4 is attached to a portion of the side wall 120 on the rear side in a manner similar to that for the first sensor BD1.

Specifically, the second sensor BD4 is disposed downstream of a mirror layer ML (not shown) of the reflecting mirror 74K in the scanning direction of the second beam LK for detecting the second beam LK. When the second sensor BD4 detects the second beam LK, the second sensor BD4 outputs, to the controller 300, a signal for correcting a deviation of a scanning exposure start position due to thermal expansion of the scanner unit 1 and an error in the surface division accuracy of the polygon mirror 40, namely, an error in the angle among different mirror surfaces of the polygon mirror 40.

The casing 100 houses the light beam source devices 20, the polygon mirror 40, the second cylindrical lenses 60, and the reflecting mirrors 71-75. The casing 100 has a support wall 110 and the side walls 120 extending upward from respective opposite end portions of the support wall 110 in the front-rear direction.

The support wall 110 is a lower wall of the casing 100 and supports the light beam source devices 20, the polygon mirror 40, the fθ lenses 50, the second cylindrical lenses 60Y, 60K, and the reflecting mirrors 72, 74. As shown in FIG. 3, the support wall 110 has four exposure openings 111-114 arranged in the front-rear direction. The laser beams LY-LK reflected by the reflecting mirrors 73, 75 and travel toward the photoconductive drums 251 pass through the corresponding exposure openings 111-114.

As shown in FIG. 1, the controller 300 is disposed in the body housing 210 and includes a CPU, a memory 310 (as one example of memory) including a RAM and a ROM, and an input/output circuit. The controller 300 is connected to the scanner unit 1 and is configured to control the light beam source devices 20 of the scanner unit 1 based on signals received from the sensors BD1, BD4 of the scanner unit 1 and programs and data stored in the memory 310.

The controller 300 has a function of starting scanning exposure of the first beams LY, LM deflected by a first surface of the polygon mirror 40 when a first-beam exposure standby time Tf (FIG. 8) elapses after the first beam LY deflected by the first surface has been detected by the first sensor BD1. Further, the controller 300 has a function of starting scanning exposure of the second beams LC, LK deflected by the second surface of the polygon mirror 40 different from the first surface when a second-beam exposure standby time Ts (FIG. 8) longer than the first-beam exposure standby time Tf elapses after the first beam LY deflected by the first surface of the polygon mirror 40 has been detected by the first sensor BD1. In other words, the controller 300 operates based on the programs stored in the memory 310, so as to function as a second means to start the scanning exposure of the second beams LC, LK based on the second-beam exposure standby time. Here, the first-beam exposure standby time Tf is a time period from a timing when the first beam LY deflected by the first surface of the polygon mirror 40 has been detected by the first sensor BD1 to a timing when the scanning exposure of the first beams LY, LM deflected by the first surface of the polygon mirror 40 is started. The second-beam exposure standby time Ts is a time period from the timing when the first beam LY deflected by the first surface of the polygon mirror 40 has been detected by the first sensor BD1 to a timing when the scanning exposure of the second beams LC, LK deflected by the second surface of the polygon mirror 40 is started.

In the present embodiment, the first surface is a mirror surface which is used to scan and expose the surfaces of the photoconductive drums 251 by the respective first beams LY, LM. That is, the first surface is one of the mirror surfaces 41-46 of the polygon mirror 40 that has reached a position at which the first beams LY, LM are reflected toward the first scanning optical system SC1. Specifically, after the first mirror surface 41 has served as the first surface, the second mirror surface 42, the third mirror surface 43, the fourth mirror surface 44, the fifth mirror surface 45, and the sixth mirror surface 46 will sequentially serve as the first surface in this order.

The second surface is a mirror surface which is used to scan and expose the surfaces of the photoconductive drums 251 by the respective second beams LC, LK. That is, the second surface is one of the mirror surfaces 41-46 of the polygon mirror 40 that has reached a position at which the second beams LC, LK are reflected toward the second scanning optical system SC2. Specifically, after the first mirror surface 41 has served as the second surface, the second mirror surface 42, the third mirror surface 43, the fourth mirror surface 44, the fifth mirror surface 45, and the sixth mirror surface 46 will sequentially serve as the second surface in this order.

Figure 8:
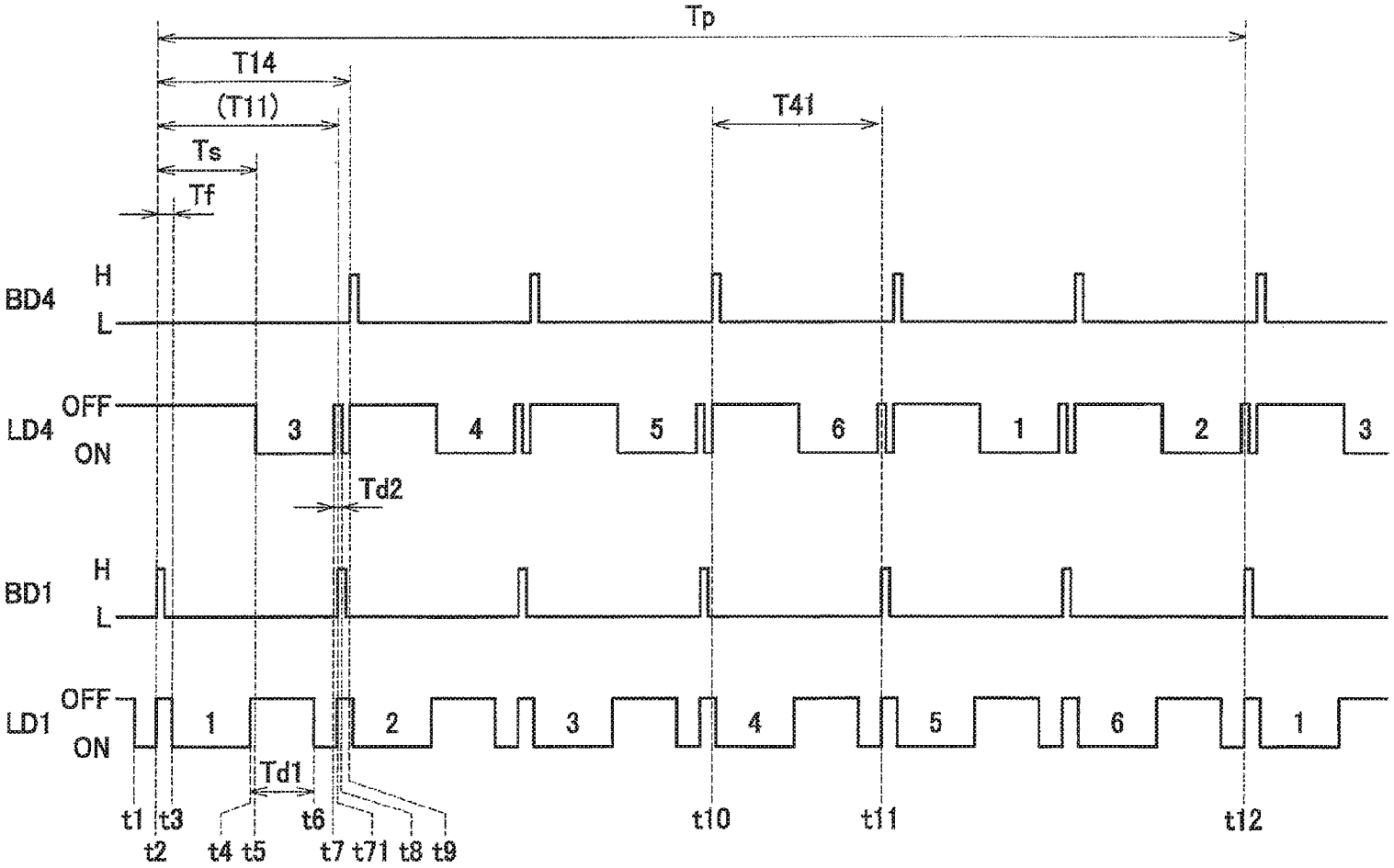
FIG. 8 is a time chart indicating correction control for the second-beam exposure standby time.

The second surface is shifted from the first surface by a predetermined angle. A relationship between the first surface and the second surface is represented by emission timings of the second beams LC, LK after the first sensor BD1 has detected the first beam LY. In the present embodiment, the second surface is a surface through the use of which the scanning exposure of the second beams LC, LK via the second scanning optical system SC2 is first performed after the first sensor BD1 has detected the first beam LY deflected by the first surface. In the present embodiment, the second surface is shifted relative to the first surface by 120°. In other words, an angle formed by a normal line of the first surface and a normal line of the second surface is 120° in an instance where the polygon mirror 40 is free from the surface division error. In the present embodiment, therefore, when the first mirror surface 41 serves as the first surface, the third mirror surface 43 serves as the second surface. That is, in an instance where the first mirror surface 41, the second mirror surface 42, the third mirror surface 43, the fourth mirror surface 44, the fifth mirror surface 45, and the sixth mirror surface 46 sequentially serve as the first surface in this order, the third mirror surface 43, the fourth mirror surface 44, the fifth mirror surface 45, the sixth mirror surface 46, the first mirror surface 41, and the second mirror surface 42 sequentially serve as the second surface in this order (FIG. 8). In the time chart of FIG. 8, numerals indicate numbers of the respective mirror surfaces. For instance, "1" indicates the first mirror surface 41, and an ON period in which "1" is indicated means that the scanning exposure is being performed using the first mirror surface 41.

The controller 300 has a function of measuring a first time T14 (FIG. 8), as one example of a measured time, which is a time period from the timing when the first beam LY deflected by the first surface of the polygon mirror 40 has been detected by the first sensor BD1 to a timing when the second beam LK deflected by the second surface of the polygon mirror 40 is detected by the second sensor BD4. Specifically, the controller 300 measures the first time T14 a plurality of times in one printing control.

The controller 300 has a function of determining the second-beam exposure standby time Ts based on the plurality of first times T14. In other words, the controller 300 operates based on the programs stored in the memory 310, so as to function as a first means to determine the second-beam exposure standby time.

Specifically, the controller 300 calculates an average value of the plurality of first times T14 and determines the second-beam exposure standby time Ts based on a difference between the average value and a reference time Tb. The reference time Tb is an ideal time corresponding to the first time T14 in an instance where the first surface and the second surface, e.g., the first mirror surface 41 and the third mirror surface 43 have a proper angular positional relationship. In the present embodiment, the reference time Tb is calculated from the following expression (1):

$$Tb=2\cdot T11-T41 \quad (1)$$

Tb: reference time T11: one-surface cycle (FIG. 8) T41: second time (FIG. 8)

The one-surface cycle T11, as shown in FIG. 8 as a reference value enclosed with parentheses, is a time period from a timing when the first beam LY has been detected by the first sensor BD1 to a timing when the first beam LY is next detected by the first sensor BD1 in an instance where the first mirror surface 41 and the second mirror surface 42 have a proper angular positional relationship. The one-surface cycle T11 is equal to one-sixth (⅙) of a rotation cycle Tp of the polygon mirror 40, namely, one-sixth (⅙) of a time required for one rotation of the polygon mirror 40. Thus, as shown in FIG. 8, the controller 300 calculates the one-surface cycle T11 by multiplying, by ⅙, a time (i.e., the rotation cycle Tp) which is a time period from a timing when the first beam LY reflected by the first mirror surface 41 has been detected by the first sensor BD1 to a timing when the first beam LY reflected again by the first mirror surface 41 after one rotation is detected by the first sensor BD1.

The thus calculated one-surface cycle T11 is obtained for the same one mirror surface using the single first sensor BD1, so that the one-surface cycle T11 is obtained as data which is not influenced by errors in the angle among different mirror surfaces and which does not vary due to thermal expansion and a change over years. That is, the thus calculated one-surface cycle T11 is always constant. In view of this, the one-surface cycle T11 need not be obtained by calculation, but may be set at a fixed value obtained based on a driving capability of a motor for rotating the polygon mirror 40.

The second time T41 is a time period from a timing when the second beam LK defected by a certain surface of the polygon mirror 40 has been detected by the second sensor BD4 to a timing when the first beam LY deflected by the certain surface is detected by the first sensor BD1. For instance, as shown in FIG. 8, the controller 300 calculates, as the second time T41, a time period from a timing when the second beam LK deflected by the fifth mirror surface 45 has been detected by the second sensor BD4 to a timing when the first beam LY deflected by the same fifth mirror surface 45 is detected by the first sensor BD1. The thus calculated second time T41 is obtained for the same one mirror surface, so that the second time T41 is obtained as data which is not influenced by errors in the angle among different mirror surfaces. Consequently, even when the second time T41 is obtained for another mirror surface other than the fifth mirror surface 45, the second time T41 is calculated to have a constant value. It is noted that, when the fθ lenses 50 and the casing 100 have suffered from thermal expansion or a change over years, the second time T41 is changed to a value influenced by the thermal expansion or the change over years.

By calculating the reference time Tb according to the above expression (1), the controller 300 updates the reference time Tb depending upon the environment. The controller 300 subtracts, from the reference time Tb, the average value of the plurality of first times T14 so as to obtain a difference therebetween, and adds the difference to the second-beam exposure standby time Ts, thereby correcting the second-beam exposure standby time Ts. That is, in an instance where the average value is smaller than the reference time Tb, namely, in an instance where the difference is positive, it means that the start timing of the scanning exposure of the second beams LC, LK was too early. In this case, the positive difference is added to the second-beam exposure standby time Ts, thereby delaying the start timing of the scanning exposure of the second beams LC, LK. Thus, the start timing is made appropriate. On the other hand, in an instance where the average value is larger than the reference time Tb, namely, in an instance where the difference is negative, it means that the start timing of the scanning exposure of the second beams LC, LK was too late. In this case, the negative difference is added to the second-beam exposure standby time Ts, thereby advancing the start timing of the scanning exposure of the second beams LC, LK. Thus, the start timing of the scanning exposure is made appropriate.

The controller 300 is configured to store, in the memory 310, the second-beam exposure standby time Ts based on the first time T14 after the polygon mirror 40 has started to be rotated and is configured to start, based on the second-beam exposure standby time Ts stored in the memory 310, the scanning exposure of the second beams LC, LK deflected by the second surface in each of a plurality of times of the scanning exposure to be performed until the polygon mirror 40 stops.

There are stored, in the memory 310, the programs, the first-beam exposure standby time Tf, the second-beam exposure standby time Ts, the plurality of first times T14, the reference time Tb, the one-surface cycle T11, the second time T41, and the expression (1). The first-beam exposure standby time Tf is set at the time of shipment of the product, for instance.

The second-beam exposure standby time Ts is set for each of the mirror surfaces 41-46 of the polygon mirror 40. The second-beam exposure standby time Ts is set at an initial value at the time of shipment and is thereafter corrected, i.e., updated and overwritten, at an initial stage of each printing control every time printing control is executed. In other words, the second-beam exposure standby time Ts is stored in the memory 310 by the number corresponding to the number of mirror surfaces of the polygon mirror 40. Specifically, there are stored, in the memory 310, the second-beam exposure standby time Ts corresponding to the first mirror surface 41, the second-beam exposure standby time Ts corresponding to the second mirror surface 42, the second-beam exposure standby time Ts corresponding to the third mirror surface 43, the second-beam exposure standby time Ts corresponding to the fourth mirror surface 44, the second-beam exposure standby time Ts corresponding to the fifth mirror surface 45, and the second-beam exposure standby time Ts corresponding to the sixth mirror surface 46. Each of the second-beam exposure standby times Ts is suitably corrected.

The controller 300 identifies, as the first mirror surface 41, one surface which has first reflected the first beam LY to the first sensor BD1 in the printing control. Further, the controller 300 identifies, as the third mirror surface 43, another surface which has first reflected the second beam LK to the second sensor BD4 in the printing control.

Next, the operations of the controller 300 will be explained. Initially, the control of the polygon mirror 40 and the first semiconductor lasers LD1, LD2 by the controller 300 will be explained.

Figure 5:
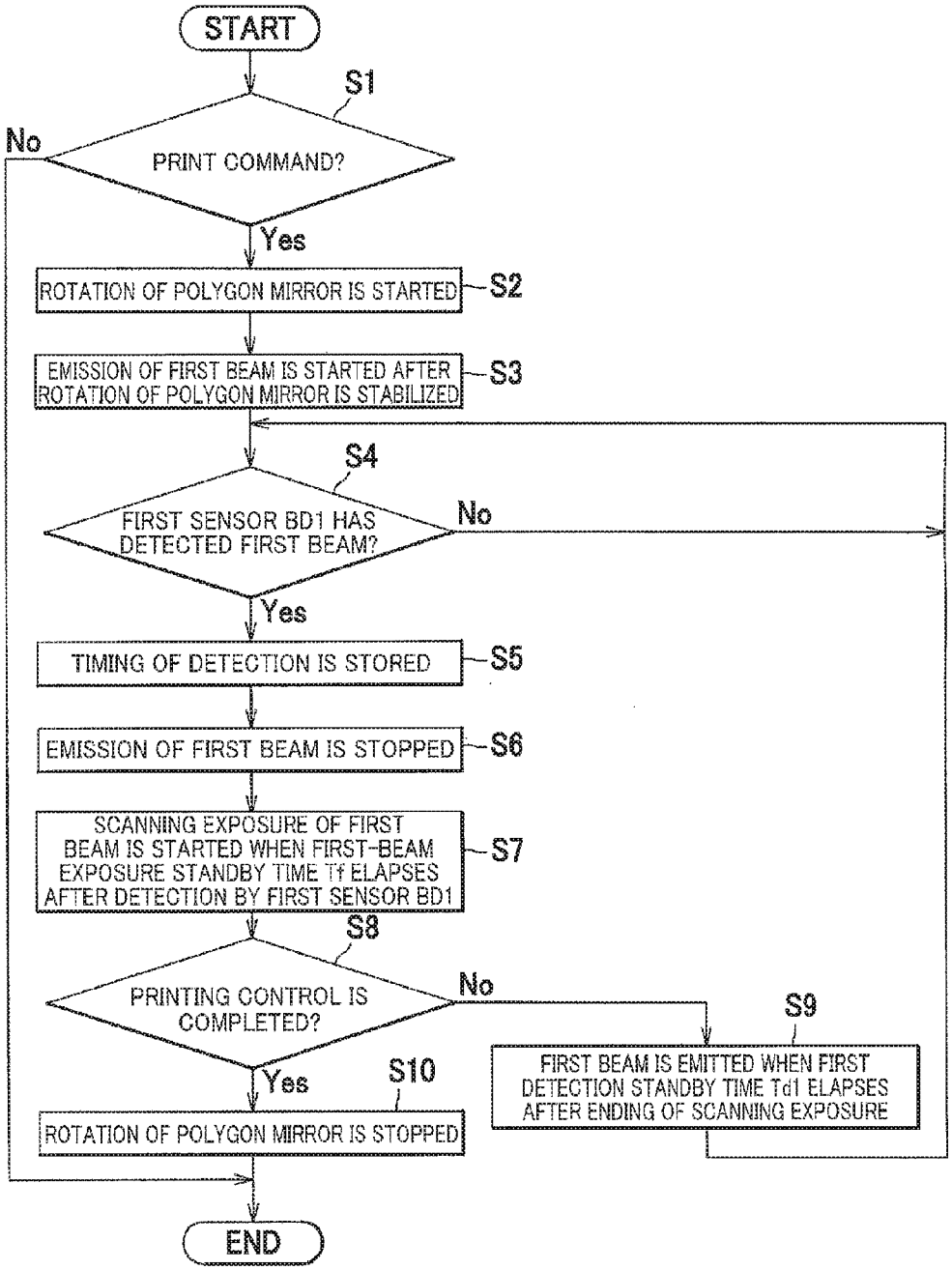
FIG. 5 is a flow chart indicating a process of controlling first semiconductor lasers.

As shown in the flow chart of FIG. 5, the controller 300 initially determines whether a print command has been input (S1). When the controller 300 determines the print command has been input (Yes), the controller 300 controls the polygon mirror 40 to start rotating (S2). When the rotation speed of the polygon mirror 40 becomes constant, namely, when the rotation of the polygon mirror 40 is stabilized, the controller 300 turns on the first semiconductor laser LD1 so as to start emission of the first beam LY (S3). In this respect, the time required for the rotation of the polygon mirror 40 to be stabilized after starting of the rotation is obtained in advance by experiments or simulations, and the controller 300 turns on the first semiconductor laser LD1 when the above-indicated time elapses after the starting of the rotation of the polygon mirror 40.

After S3, the controller 300 determines whether the first sensor BD1 has detected the first beam LY (S4). When the controller 300 determines at S4 that the first sensor BD1 has detected the first beam LY, the controller 300 stores the timing of detection (S5) and turns off the first semiconductor laser so as to stop emission of the first beam LY (S6).

After S6, the controller 300 starts the scanning exposure of the first semiconductor lasers LD1, LD2 when the first-beam exposure standby time Tf elapses after the first sensor BD1 has detected the first beam LY (S7). The scanning exposure is performed mainly by controlling the first semiconductor lasers LD1, LD2 to be turned on an off based on the image data. However, it is noted that, at a stage before the control based on the image data is executed, namely, at a stage before an electrostatic latent image based on the image data is formed on the photoconductive drums 251, the first semiconductor lasers LD1, LD2 may be controlled otherwise. That is, at the stages indicated above, the first semiconductor lasers LD1, LD2 may be kept turned off or may be kept turned on.

After the scanning exposure at S7 has been performed, the controller 300 turns off the first semiconductor lasers LD1, LD2 and determines whether the printing control is completed (S8). When the controller determines at S8 that the printing control is not yet completed (No), the controller 300 turns on the first semiconductor laser LD1 such that the first beam LY to be detected by the first sensor BD1 is emitted, when a first detection standby time Td1 (FIG. 8) elapses after ending of the scanning exposure (S9). Subsequently, the control flow returns to S4.

When it is determined at S8 that the printing control is completed (Yes), the controller 300 stops the polygon mirror 40 and ends the control of the first semiconductor lasers LD1, LD2.

Figure 6:
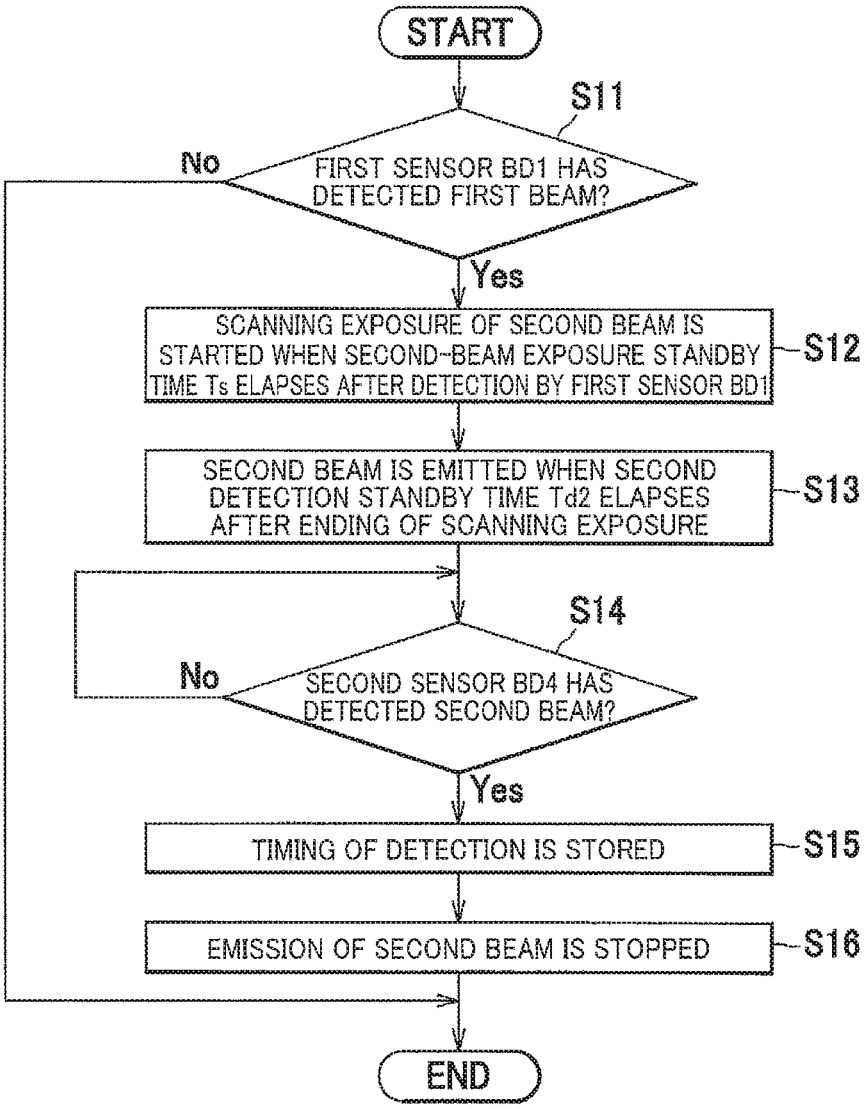
FIG. 6 is a flow chart indicating a process of controlling second semiconductor lasers.

Referring next to the flow chart of FIG. 6, the control of the second semiconductor lasers LD3, LD4 will be explained. The controller 300 initially determines whether the first sensor BD1 has detected the first beam LY (S11). When the controller 300 determines at S11 that the first sensor BD1 has detected the first beam LY (Yes), the controller 300 starts scanning exposure of the second semiconductor lasers LD3, LD4 when the second-beam exposure standby time Ts elapses after the first sensor BD1 has detected the first beam LY (S12). After the scanning exposure at S12 has been performed, the controller 300 turns off the second semiconductor lasers LD3, LD4.

Subsequently, the controller 300 turns on the second semiconductor laser LD4 such that the second beam LK to be detected by the second sensor BD4 is emitted (S13) when a second detection standby time Td2 (FIG. 8) elapses after ending of the scanning exposure. After S13, the controller 300 determines whether the second sensor BD4 has detected the second beam LK (S14).

When it is determined at S14 that the second sensor BD4 has detected the second beam LK (Yes), the controller 300 stores the timing of detection (S15) and turns off the second semiconductor lasers LD4 so as to stop emission of the second beam LK (S16).

Figure 7:
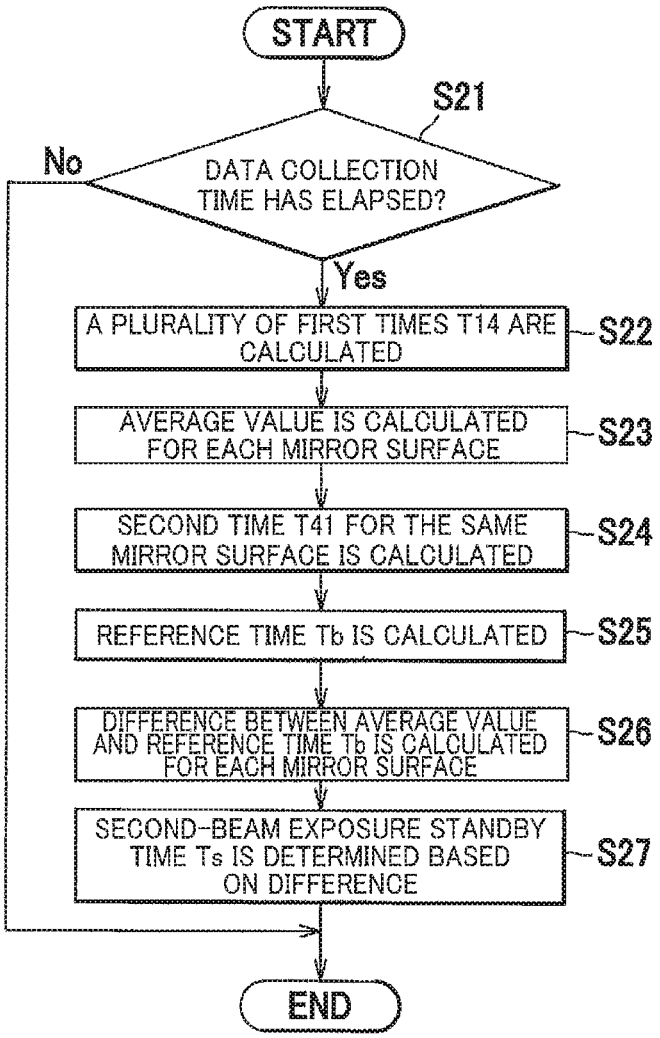
FIG. 7 is a flow chart indicating a process of correcting a second-beam exposure standby time.

Referring next to the flow chart of FIG. 7, the control for correcting the second-beam exposure standby time Ts will be explained. The controller 300 initially determines whether a predetermined data collection time has elapsed after the rotation of the polygon mirror 40 was stabilized (S21). The data collection time is a time required for obtaining a plurality of timings for calculating a plurality of first times T14 for each of the mirror surfaces 41-46 of the polygon mirror 40. For instance, the data collection time may be set to a time required for the polygon mirror 40 in a stabilized state to rotate three times or more.

When it is determined at S21 that the data collection time has elapsed (Yes), the controller 300 calculates the plurality of first times T14 for each mirror surface 41-46 of the polygon mirror 40 based on a plurality of timings of detection by the first sensor BD1 and a plurality of timings of detection by the second sensor BD4 (S22). After S22, the controller 300 calculates an average value of the plurality of first times T14 for each mirror surface 41-46 (S23).

After S23, the controller 300 calculates the second time T41 based on the timing of detection, by the second sensor BD4, of the second beam LK deflected by the fifth mirror surface 45 and the timing of detection, by the first sensor BD1, of the first beam LY deflected by the same fifth mirror surface 45 (S24). After S24, the controller 300 calculates the reference time Tb based on the rotation cycle Tp of the polygon mirror 40 and the calculated second time T41 (S25).

After S25, the controller 300 calculates, for each mirror surface 41-46, a difference between the reference time Tb and the average value of the plurality of first times T14 (S26). After S26, the controller 300 determines the second-beam exposure standby time Ts for each mirror surface 41-46 based on the calculated difference (S27).

Figure 9:
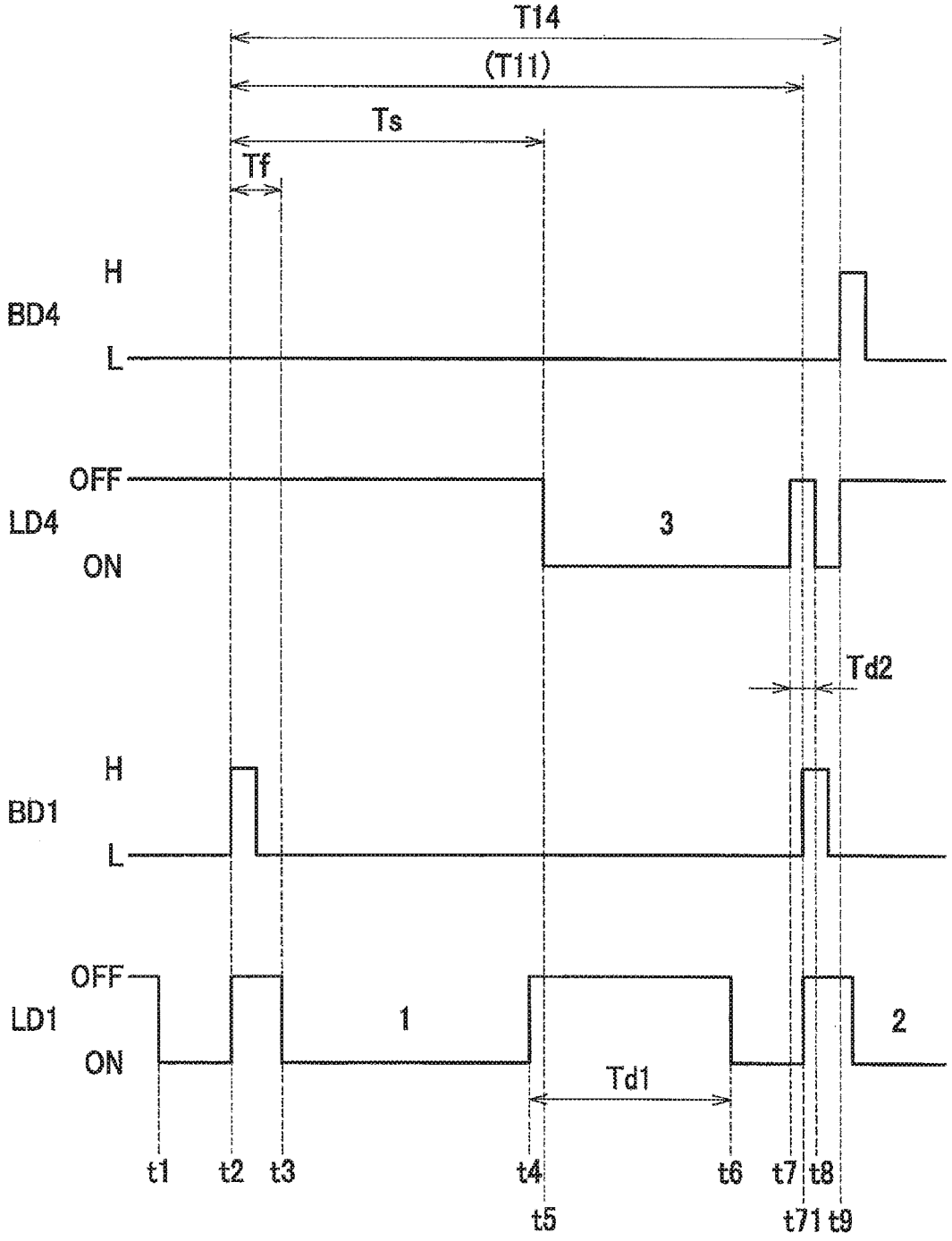
FIG. 9 is an enlarged view of a portion around timings t1-t9 in FIG. 8.

Referring next to the time charts of FIGS. 8 and 9, the control for correcting the second-beam exposure standby time Ts will be explained in detail. It is noted that the control of the first semiconductor laser LD2 for magenta is substantially similar to the control of the first semiconductor laser LD1 for yellow and the control of the second semiconductor laser LD3 for cyan is substantially similar to the control of the second semiconductor laser LD4 for black. In view of this, the control of the first semiconductor laser LD2 for magenta and the control of the second semiconductor laser LD3 for cyan are not explained below. FIG. 9 is a time chart showing around timings t1-t9 of FIG. 8 in enlargement.

As shown in FIGS. 8 and 9, when the rotation speed of the polygon mirror 40 becomes constant after the controller 300 has started rotating the polygon mirror 40 in response to the print command, the controller 300 turns on the first semiconductor laser LD1 (timing 0). Subsequently when the first sensor BD1 detects the first beam LY (timing t2), the controller 300 stores the timing of detection (timing 2) and turns off the first semiconductor laser LD1. As shown in FIGS. 8 and 9, the first sensor BD1 is configured such that its output level changes from "L" to "H" when the first sensor BD1 detects the first beam LY.

When the first-beam exposure standby time Tf elapses (timing t3) after the timing of detection (timing 2) by the first sensor BD1, the controller 300 performs the scanning exposure using the first semiconductor laser LD1 and the first mirror surface 41 and turns off the first semiconductor laser LD1 after ending of the scanning exposure (timing t4). When the first detection standby time Td1 elapses (timing t6) after ending of the scanning exposure (timing t4), the controller 300 turns on the first semiconductor laser LD1 such that the first beam LY to be detected by the first sensor BD1 is emitted.

When the second-beam exposure standby time Ts elapses (timing t5) after the timing of detection (timing 2) by the first sensor BD1, the controller 300 performs the exposure scanning of the second semiconductor laser LD4 and the third mirror surface 43 and turns off the second semiconductor laser LD4 after ending of the scanning exposure (timing t7). When the second detection standby time Td2 elapses (timing t8) after ending of the scanning exposure (timing t7), the controller 300 turns on the second semiconductor laser LD4 such that the second beam LK to be detected by the second sensor BD4 is emitted. Subsequently when the second sensor BD4 detects the second beam LK (timing t9), the controller 300 stores the timing of detection (timing 9) and turns off the second semiconductor laser LD4. As shown in FIGS. 8 and 9, the second sensor BD4 is configured such that its output level changes from "L" to "H" when the second sensor BD4 detects the second beam LK.

The control described above is executed for each of the mirror surfaces 42-46 which will sequentially serve as the first surface thereafter and for each of the mirror surfaces 44-42 which will sequentially serve as the second surface thereafter. While FIG. 8 shows the control for one rotation of the polygon mirror 40, the control is executed for three rotations of the polygon mirror 40, for instance.

According to the control described above, the controller 300 calculates the first time T14 and the second time T41 based on the obtained timing. For instance, by subtracting the timing t2 from the timing t9, the controller 300 calculates the first time T14 in an instance where the first mirror surface 41 serves as the first surface and the third mirror surface 43 serves as the second surface. The controller 300 calculates the first time T14 by the number of rotations of the polygon mirror 40 and calculates an average value of the calculated first times T14. The average value is similarly calculated in other instances in which other mirror surfaces serve as the first surface and the second surface.

The controller 300 calculates the second time T41 based on the timing of detection t10 when the second sensor BD4 has detected the second beam LK deflected by the fifth mirror surface 45 and the timing of detection t11 when the first sensor BD1 has detected the first beam LY deflected by the same fifth mirror surface 45, namely, by subtracting the timing t10 from the timing t11. Further, the controller 300 calculates the rotation cycle Tp of the polygon mirror 40 based on the timing of detection (timing t2) when the first beam LY deflected by the first mirror surface 41 has been detected by the first sensor BD1 and the timing of detection (timing t12) when the first beam LY deflected again by the first mirror surface 41 after one rotation has been detected by the first sensor BD1, namely, by subtracting the timing t2 from the timing t12.

Thereafter, the controller 300 calculates the one-surface cycle T11 by multiplying the rotation cycle Tp of the polygon mirror 40 by ⅙ and calculates the reference time Tb based on the one-surface cycle T11, the second time T41, and the above expression (1). The controller 300 calculates a difference between the reference time Tb and the first time T14, determines the second-beam exposure standby time Ts based on the difference, and overwrites the determined second-beam exposure standby time Ts in the memory 310.

When the semiconductor lasers LD1-LD4 are thereafter controlled based on the image data, the controller 300 performs the scanning exposure using the second surface based on the second-beam exposure standby time Ts overwritten in the memory 310. That is, a plurality of times of scanning exposure using the second surface based on the image data are performed using the second-beam exposure standby time Ts determined before execution of the control based on the image data. The same second-beam exposure standby time Ts is used in each of the plurality of times of scanning exposure until the plurality of times of scanning exposure end, namely, until the rotation of the polygon mirror 40 is stopped.

According to the present embodiment, the following advantages are obtained.

Even where the angle of the second surface relative to the first surface is deviated from a normal angle, the position of the image to be formed by the scanning exposure using the first surface and the position of the image to be formed by the scanning exposure using the second surface can be aligned with each other by determining the second-beam exposure standby time Ts using the first time T14. Further, the first time T14 is a time period from the timing of detection by the first sensor BD1 to the timing of detection by the second sensor BD4. Thus, the second-beam exposure standby time Ts is accurately determined based on the detection results of both of the first beam LY and the second beam LK.

The reference time Tb is set based on the rotation cycle Tp and the second time T41 which are calculated based on the detection results by both of the sensors BD1, BD4. Thus, even if thermal expansion or a change over years is generated, this configuration allows the second-beam exposure standby time Ts to be accurately determined depending upon situations, as compared with a configuration in which the reference time is set at a fixed value.

The second-beam exposure standby time Ts is determined based on the average value of the plurality of first times T14. It is thus possible to perform the scanning exposure of the second beams LC, LK based on more accurate second-beam exposure standby time Ts, as compared with a configuration in which the second-beam exposure standby time is determined based on a single first time.

After the printing control has been started, the second-beam exposure standby time Ts is determined and is stored in the memory 310, and the second-beam exposure standby time Ts stored in the memory 310 is not changed in a plurality of times of scanning exposure to be performed until the polygon mirror 40 stops. Consequently, this configuration is not likely to be influenced by errors, as compared with a configuration in which the second-beam exposure standby time is changed and overwritten every one rotation of the polygon mirror 40.

The second surface is defined as a surface through the use of which the scanning exposure of the second beams LC, LK via the second scanning optical system SC2 is first performed after the first beam LY deflected by the first surface has been detected by the first sensor BD1. It is thus possible to perform the scanning exposure via the second scanning optical system SC2 soon after the detection by the first sensor BD1. This configuration reduces the rotation amount of the polygon mirror 40 in a time period from the timing of the detection by the first sensor BD1 to the timing of start of the scanning exposure of the second beams LC, LK, thereby reducing influences of a variation in the rotation amount of the polygon mirror 40.

It will be understood that the invention is not limited to the details of the illustrated embodiment, but may be embodied otherwise as described below.

In the illustrated embodiment, the rotation cycle Tp of the polygon mirror 40 is calculated based on the detection by the first sensor BD1. The rotation cycle Tp of the polygon mirror 40 may be calculated based on the detection by the second sensor BD4.

In the illustrated embodiment, the average value of the plurality of first times T14 is one example of the measured time that is compared with the reference time Tb. The measured time may be a single first time T14. Further, the measured time may be a value obtained by excluding, from the plurality of first times T14, some first times T14 which are different from the rest of the first times T14 by not smaller than a predetermined amount and by averaging the rest of the first times T14.

While the polygon mirror 40 has a hexagonal shape in the illustrated embodiment, the polygon mirror may have a quadrilateral shape, an octagonal shape, or other polygonal shape.

In the illustrated embodiment, each of the photoconductive drums 251 is one example of the photoconductor. The photoconductor may be in the form of a belt, for instance.

The principle of the invention is applicable to not only the color printer 200 in the illustrated embodiment, but also other image forming apparatuses such as a copying machine and a multi-function peripheral.

What is claimed is:

1. An image forming apparatus, comprising:

a first light beam source and a second light beam source;

a polygon mirror configured to deflect a first beam emitted from the first light beam source and a second beam emitted from the second light beam source;

a first scanning optical system disposed on one side of the polygon mirror and configured to focus the first beam deflected by the polygon mirror on a first photoconductor;

a first optical sensor disposed at an upstream portion of the first scanning optical system in a scanning direction of the first beam and configured to detect the first beam deflected by the polygon mirror;

a second scanning optical system disposed on another side of the polygon mirror and configured to focus the second beam deflected by the polygon mirror on a second photoconductor;

a second optical sensor disposed at a downstream portion of the second scanning optical system in a scanning direction of the second beam and configured to detect the second beam deflected by the polygon mirror; and a controller, wherein the controller is configured to determine a second-beam exposure standby time which is a time period from a timing when the first beam deflected by a first surface of the polygon mirror has been detected by the first optical sensor to a timing when scanning exposure of the second beam deflected by a second surface of the polygon mirror different from the first surface is started, based on a measured time which is a time period from the timing when the first beam deflected by the first surface has been detected by the first optical sensor to a timing when the second beam deflected by the second surface is detected by the second optical sensor, and wherein the controller is configured to start the scanning exposure of the second beam deflected by the second surface when the second-beam exposure standby time elapses after the first beam deflected by the first surface has been detected by the first optical sensor.

2. The image forming apparatus according to claim 1, wherein the controller is configured to determine a plurality of the second-beam exposure standby times corresponding to the number of surfaces of the polygon mirror.

3. The image forming apparatus according to claim 1, wherein the controller is configured to determine the second-beam exposure standby time based on a difference between the measured time and a reference time.

4. The image forming apparatus according to claim 3, wherein the controller is configured to determine the reference time based on: a rotation cycle of the polygon mirror; and a time period from a timing when the second beam deflected by a certain surface of the polygon mirror has been detected by the second optical sensor to a timing when the first beam deflected by the certain surface is detected by the first optical sensor.

5. The image forming apparatus according to claim 1, wherein the controller is configured to obtain a plurality of the measured times and to determine the second-beam exposure standby time based on the plurality of the measured times.

6. The image forming apparatus according to claim 1, further comprising a memory, wherein the controller is configured to store, in the memory, the second-beam exposure standby time based on the measured time after the polygon mirror has started to rotate, and wherein the controller is configured to start, based on the second-beam exposure standby time stored in the memory, the scanning exposure of the second beam deflected by the second surface in each of a plurality of times of the scanning exposure to be performed until the polygon mirror stops.

7. The image forming apparatus according to claim 6, wherein a plurality of the second-beam exposure standby times corresponding to the number of surfaces of the polygon mirror are stored in the memory.

8. The image forming apparatus according to claim 1, wherein the second surface is a surface through the use of which the scanning exposure of the second beam is first performed after the first beam deflected by the first surface has been detected by the first optical sensor.

9. An image forming apparatus, comprising:

a first light beam source configured to emit a first beam;

a second light beam source configured to emit a second beam;

a polygon mirror;

a first scanning optical system disposed on one side of the polygon mirror and configured to focus the first beam;

a first optical sensor disposed at an upstream portion of the first scanning optical system in a scanning direction of the first beam;

a second scanning optical system disposed on another side of the polygon mirror and configured to focus the second beam;

a second optical sensor disposed at a downstream portion of the second scanning optical system in a scanning direction of the second beam; and a controller, wherein the controller is configured to:

control the polygon mirror to rotate;

control the first light beam source to emit a first beam;

control the second light beam source to emit a second beam;

obtain a measured time which is a time period from a timing when the first beam deflected by a first surface of the polygon mirror has been detected by the first optical sensor and a timing when the second beam deflected by a second surface of the polygon mirror different from the first surface is detected by the second optical sensor;

determine, based on the measured time, a second-beam exposure standby time which is a time period from the timing when the first beam deflected by the first surface is detected by the first optical sensor to a timing when scanning exposure of the second beam deflected by the second surface is started; and start the scanning exposure of the second beam deflected by the second surface when the second-beam exposure standby time elapses after the first beam deflected by the first surface has been detected by the first optical sensor.

10. A method of controlling a beam scanning device, the beam scanning device comprising: a first light beam source and a second light beam source; a polygon mirror configured to deflect a first beam emitted from the first light beam source and a second beam emitted from the second light beam source; a first scanning optical system disposed on one side of the polygon mirror and configured to focus the first beam deflected by the polygon mirror on a first photoconductor; a first optical sensor disposed at an upstream portion of the first scanning optical system in a scanning direction of the first beam and configured to detect the first beam detected by the polygon mirror; a second scanning optical system disposed on another side of the polygon mirror and configured to focus the second beam deflected by the polygon mirror on a second photoconductor; and a second optical sensor disposed at a downstream portion of the second scanning optical system in a scanning direction of the second beam and configured to detect the second beam deflected by the polygon mirror, the method comprising:

determining a second-beam exposure standby time which is a time period from a timing when the first beam deflected by a first surface of the polygon mirror has been detected by the first optical sensor to a timing when scanning exposure of the second beam deflected by a second surface of the polygon mirror different from the first surface is started, based on a measured time which is a time period from the timing when the first beam deflected by the first surface has been detected by the first optical sensor to a timing when the second beam deflected by the second surface is detected by the second optical sensor; and starting the scanning exposure of the second beam deflected by the second surface when the second-beam exposure standby time elapses after the first beam deflected by the first surface has been detected by the first optical sensor.

* * * * *